US011233340B2

(12) United States Patent
Niemelä et al.

(10) Patent No.: US 11,233,340 B2
(45) Date of Patent: Jan. 25, 2022

(54) POLARIZED ANTENNA ARRAY

(71) Applicant: NOKIA SOLUTIONS AND NETWORKS OY, Espoo (FI)

(72) Inventors: Antti-Heikki Niemelä, Oulu (FI); Jere Rusanen, Oulu (FI)

(73) Assignee: NOKIA SOLUTIONS AND NETWORKS OY, Espoo (FI)

( * ) Notice: Subject to any disclaimer, the term of this patent is extended or adjusted under 35 U.S.C. 154(b) by 0 days.

(21) Appl. No.: 17/008,843

(22) Filed: Sep. 1, 2020

(65) Prior Publication Data

US 2021/0066819 A1 Mar. 4, 2021

(30) Foreign Application Priority Data

Sep. 2, 2019 (EP) ..... 19194821

(51) Int. Cl.
*H01Q 25/00* (2006.01)
*H01Q 3/36* (2006.01)
(Continued)

(52) U.S. Cl.
CPC ..... *H01Q 25/001* (2013.01); *H01Q 3/36* (2013.01); *H01Q 21/0006* (2013.01); *H01Q 21/08* (2013.01); *H01Q 21/245* (2013.01)

(58) Field of Classification Search
CPC .. H01Q 21/0006; H01Q 21/08; H01Q 21/245; H01Q 21/24; H01Q 3/36; H01Q 3/38; H01Q 25/001
(Continued)

(56) References Cited

U.S. PATENT DOCUMENTS 4,543,579 A 9/1985 Teshirogi
4,630,040 A * 12/1986 Haertling ..... G02F 1/23 345/48
(Continued)

FOREIGN PATENT DOCUMENTS

FR 2 779 873 A1 12/1999
WO WO 2006/110026 A1 10/2006

OTHER PUBLICATIONS

Mao et al., *Multimode Resonator-Fed Dual-Polarized Antenna Array with Enhanced Bandwidth and Selectivity,* IEEE Transactions on Antennas and Propagation, vol. 63, No. 12 (Dec. 2015), pp. 5492-5499.
(Continued)

*Primary Examiner* — Lam T Mai
(74) *Attorney, Agent, or Firm* — Alston & Bird LLP

(57) ABSTRACT

A polarized antenna array is provided that includes multiple polarized antenna elements. The polarized antenna array has a polarization vector defining a co-polarization direction and a cross-polarization direction. The multiple polarized antenna elements include a first sub-set of polarized antenna elements that collectively have a first polarization vector and a second sub-set of polarized antenna elements that collectively have a second polarization vector. Application of a controlled phase difference between the first sub-set of polarized antenna elements and the second sub-set of polarized antenna elements causes constructive combination of the first polarization vector and second polarization vector in the co-polarization direction and destructive combination of the first polarization vector and the second polarization vector in the cross-polarization direction.

20 Claims, 4 Drawing Sheets

(51) Int. Cl.
*H01Q 21/00* (2006.01)
*H01Q 21/08* (2006.01)
*H01Q 21/24* (2006.01)

(58) Field of Classification Search
USPC ..... 343/763, 767, 784, 786
See application file for complete search history.

(56) References Cited

U.S. PATENT DOCUMENTS 5,892,486 A 4/1999 Cook et al.
6,490,043 B1 * 12/2002 Kebabian ..... G01J 3/2823 356/453
8,879,997 B2 11/2014 Barker et al.
9,571,183 B2 2/2017 Runyon et al.
10,938,110 B2 * 3/2021 Hinman ..... H01Q 11/08
10,998,621 B1 * 5/2021 Judd ..... H01Q 1/523
2009/0315802 A1 * 12/2009 Johansen ..... H01Q 13/085 343/853
2010/0153045 A1 * 6/2010 Teshirogi ..... H04B 17/102 702/76
2013/0027259 A1 * 1/2013 Fujita ..... H01Q 13/206 343/731
2013/0082893 A1 * 4/2013 Wang ..... H01Q 9/26 343/810
2014/0037291 A1 * 2/2014 Yan ..... H04B 10/6163 398/65
2014/0375517 A1 * 12/2014 Shiue ..... H01Q 13/0225 343/776
2015/0009083 A1 * 1/2015 Shiue ..... H01Q 13/02 343/776
2015/0155737 A1 * 6/2015 Mayo ..... H02J 50/80 320/108
2015/0207235 A1 * 7/2015 Lee ..... H01Q 21/24 343/767
2015/0214592 A1 * 7/2015 Peng ..... H01Q 9/0457 343/821
2015/0357707 A1 * 12/2015 Tsutsumi ..... H01Q 3/12 343/763
2016/0065283 A1 * 3/2016 Liu ..... H04B 7/065 370/329
2017/0194703 A1 7/2017 Watson
2017/0288312 A1 10/2017 Koskiniemi et al.
2018/0076881 A1 * 3/2018 Zhu ..... H04B 7/0434
2019/0097327 A1 * 3/2019 Mohamadi ..... G01S 7/026
2020/0303795 A1 * 9/2020 Junttila ..... H01P 1/184

OTHER PUBLICATIONS

Extended European Search Report for European Application No. 19194821.5 dated Feb. 17, 2020, 10 pages.
Sanchez-Barbetty et al., "Interleaved Sparse Arrays for Polarization Control of Electronically Steered Phased Arrays for Meteorological Applications", IEEE Transactions on Geoscience and Remote Sensing, vol. 50, No. 1 (Apr. 2012), pp. 1283-1290.

* cited by examiner

POLARIZED ANTENNA ARRAY

CROSS-REFERENCE TO RELATED APPLICATIONS

This application claims priority to European Application No. 19194821.5, filed Sep. 2, 2019, the entire contents of which are incorporated herein by reference.

TECHNOLOGICAL FIELD

Embodiments of the present disclosure relate to a polarized antenna array. Some relate to a polarized antenna array providing good cross-polar discrimination of a steered polarized radio frequency beam.

BACKGROUND

Beam steering of a polarized radio frequency beam is used, for example, in modern radio communication. During beam steering a beam steering vector aligned with the beam is varied. A phased array of the same polarized antenna elements, in a common plane, is often used for beam steering. The array has a polarization vector defining a co-polarization direction and a cross-polarization direction. Each polarized antenna element has a polarization vector parallel to the co-polarization direction. During beam steering, as a projection of the beam steering vector onto the plane of the array changes from being parallel to the polarization vector of the antenna array to being orthogonal to the polarization vector of the antenna array, then cross-polar discrimination for the beam decreases.

It would be desirable to improve cross-polar discrimination for a steered polarized radio frequency beam.

BRIEF SUMMARY

According to various, but not necessarily all, embodiments there is provided a polarized antenna array comprising multiple polarized antenna elements, wherein the polarized antenna array has a polarization vector defining a co-polarization direction and a cross-polarization direction, wherein the multiple polarized antenna elements comprise a first sub-set of polarized antenna elements that collectively have a first polarization vector and a second sub-set of polarized antenna elements that collectively have a second polarization vector, wherein application of a controlled phase difference between the first sub-set of polarized antenna elements and the second sub-set of polarized antenna elements causes constructive combination of the first polarization vector and second polarization vector in the co-polarization direction and destructive combination of the first polarization vector and the second polarization vector in the cross-polarization direction.

In some but not necessarily all examples, one or more characteristics of the multiple antenna elements vary between the first sub-set and the second sub-set of antenna elements along the co-polarization direction and do not vary between the first sub-set and the second sub-set of antenna elements along the cross-polarization direction.

In some but not necessarily all examples, an E-field component in the co-polarization direction of the multiple antenna elements has opposite sense for the first sub-set of antenna elements compared to the second sub-set of antenna elements and an E-field component in the cross-polarization direction of the multiple antenna elements has same sense for the first sub-set of antenna elements compared to the second sub-set of antenna elements.

In some but not necessarily all examples, an orientation of the multiple antenna elements relative to the co-polarization direction and the cross-polarization direction varies between the first sub-set and the second sub-set of antenna elements.

In some but not necessarily all examples, multiple antenna elements are arranged in a symmetric pattern such that antenna elements of the first sub-set of antenna elements alternate with antenna elements of the second sub-set of antenna elements.

In some but not necessarily all examples, the first sub-set of polarized antenna elements are arranged along first straight lines and the second sub-set of polarized antenna elements are arranged along second straight lines, wherein the first straight lines and the second straights lines alternate.

In some but not necessarily all examples, the first sub-set of polarized antenna elements are arranged with even spacing along the first straight lines and the first straight lines are evenly spaced apart, and the second sub-set of polarized antenna elements are arranged with even spacing along the second straight lines and the second straight lines are evenly spaced apart. In some but not necessarily all examples, the first straight lines and the second straight lines extend parallel to the cross-polarization direction.

In some but not necessarily all examples, the multiple antenna elements are arranged in a planar array in parallel rows and parallel columns, wherein the rows are parallel to the cross-polarization direction, and the columns are parallel to the co-polarization direction.

In some but not necessarily all examples, the first sub-set of polarized antenna elements and the second sub-set of polarized antenna elements are arranged in alternate rows of the planar array. In some but not necessarily all examples, the antenna elements have reflective symmetry in an axis parallel to the co-polarization direction and do not have reflective symmetry in an axis parallel to cross-polarization direction.

In some but not necessarily all examples, the antenna elements are configured to have polarization vectors parallel to the co-polarization direction.

In some but not necessarily all examples, the antenna elements are elements supported by a common printed circuit board.

In some but not necessarily all examples, an apparatus comprises the polarized antenna array and means for applying a phase difference between the first sub-set and the second sub-set causes constructive combination of the first polarization vector and second polarization vector in the co-polarization direction and destructive combination of the first polarization vector and the second polarization vector in the cross-polarization direction. In some but not necessarily all examples, the apparatus comprises means for beam steering using the polarized antenna array.

In some but not necessarily all examples, ab apparatus comprises the polarized antenna array and reactive components configured to apply a phase difference between feeds of the first sub-set of antenna elements and feeds of the second sub-set of antenna elements. In some but not necessarily all examples, the apparatus comprises means for beam steering using the polarized antenna array.

According to various, but not necessarily all, embodiments there is provided a polarized antenna array comprising a first sub-set of polarized antenna elements that are arranged in first lines that are separated in a first direction and extend in a second direction orthogonal to the first direction wherein each of the polarized antenna elements in the first sub-set have an axis of reflection symmetry parallel to the first direction;

a second sub-set of polarized antenna elements that are arranged in second lines that are separated in the first direction and extend in the second direction wherein each of the polarized antenna elements in the second sub-set have an axis of reflection symmetry parallel to the first direction;

wherein the first and second lines alternate and wherein the polarized antenna elements in the first sub-set are physically rotated 180°, within a plane occupied by the first and second lines, relative to the polarized antenna elements in the second sub-set.

According to various, but not necessarily all, embodiments there is provided examples as claimed in the appended claims.

BRIEF DESCRIPTION

Some example embodiments will now be described with reference to the accompanying drawings in which.

DETAILED DESCRIPTION

Figure 1:
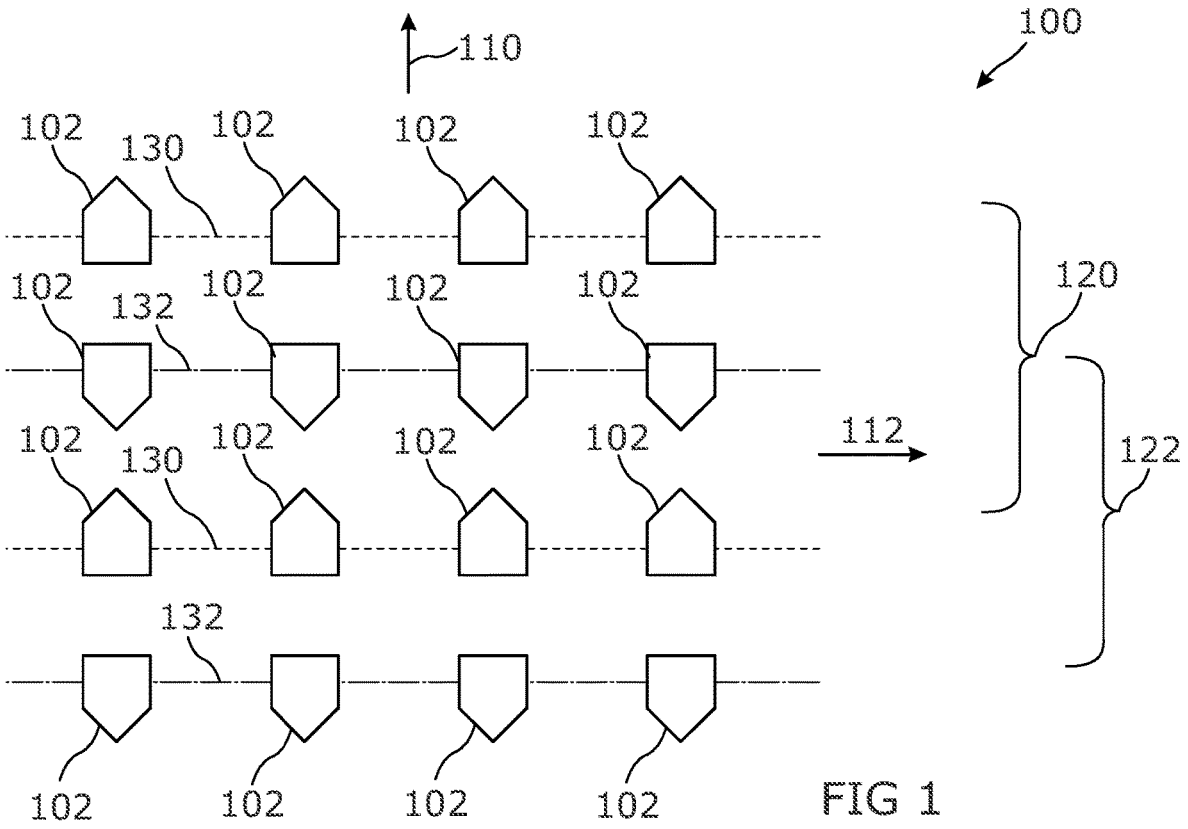
FIG. 1 shows an example embodiment of the subject matter described herein.

FIG. 1 illustrates an example of a polarized antenna array 100 comprising multiple polarized antenna elements 102, wherein the polarized antenna array 100 has a polarization vector defining a co-polarization direction 110 and a cross-polarization direction 112.

The multiple polarized antenna elements 102 comprise a first sub-set 120 of polarized antenna elements 102 and a second sub-set 122 of polarized antenna elements 102.

Figure 2:
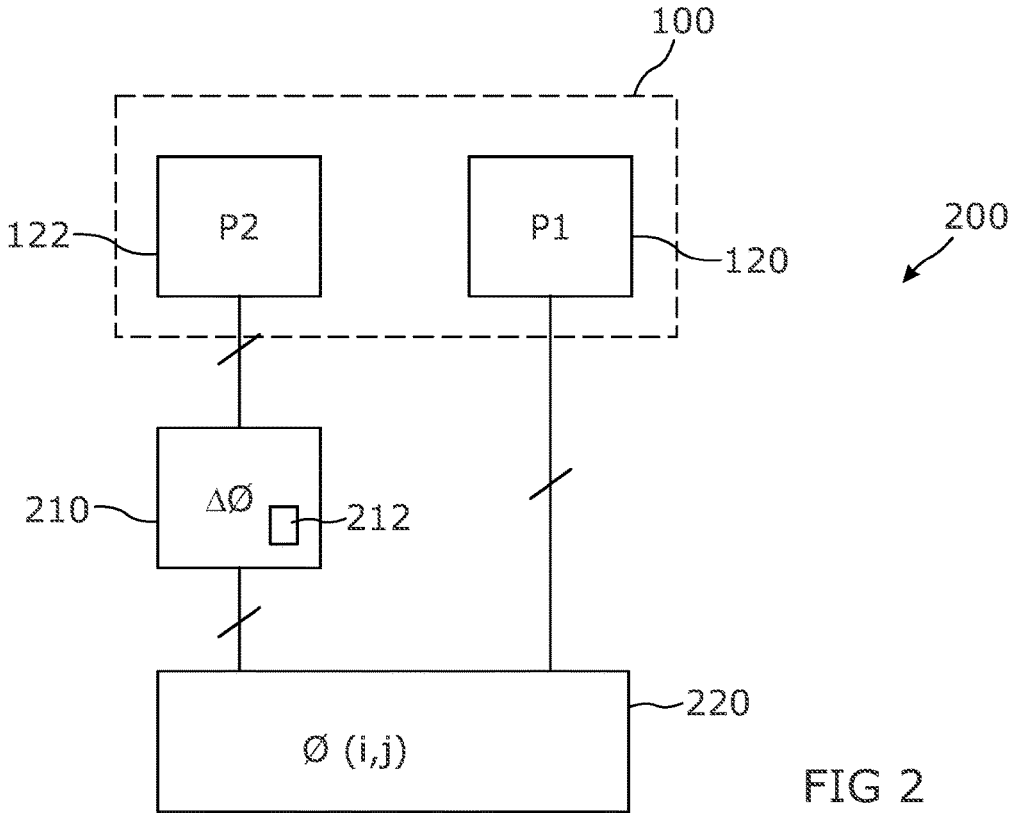
FIG. 2 shows another example embodiment of the subject matter described herein.
Figure 3A:
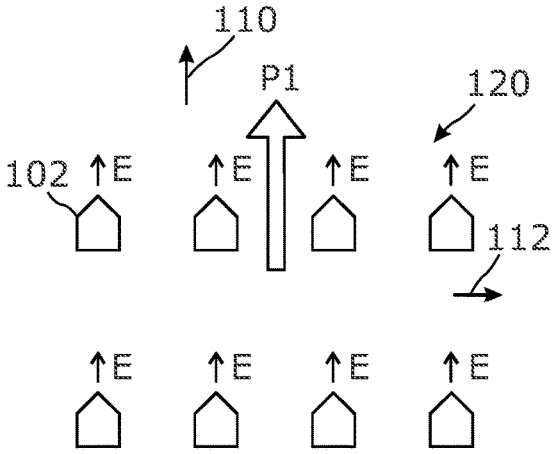
FIGS. 3A and 3B show an example embodiment of the subject matter described herein.
Figure 3B:
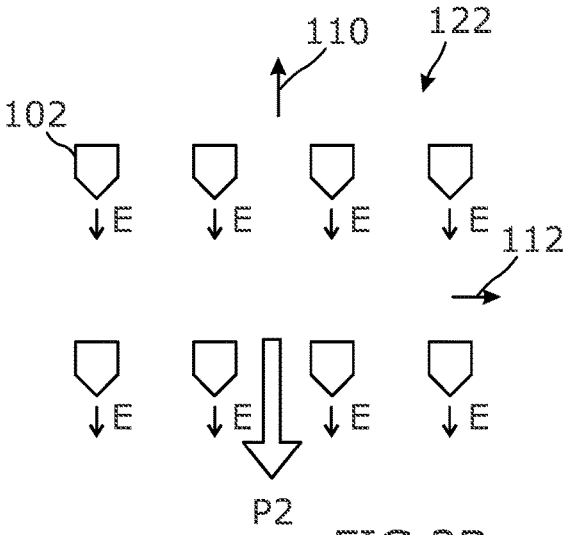

As illustrated in FIGS. 2 and 3A the first sub-set 120 of polarized antenna elements 102 collectively have a first polarization vector P1. As illustrated in FIGS. 2 and 3B the second sub-set 122 of polarized antenna elements 102 collectively have a second polarization vector P2.

As will be described later, with reference to FIGS. 4A, 4B and 4C, application of a controlled phase difference between the first sub-set 120 of polarized antenna elements 102 and the second sub-set 122 of polarized antenna elements 102 causes constructive combination of the first polarization vector P1 and second polarization vector P2 in the co-polarization direction 110 and destructive combination of the first polarization vector P1 and the second polarization vector P2 in the cross-polarization direction 112.

As can be seen from FIG. 1, FIGS. 3A & 3B and FIGS. 4A & 4B, one or more characteristics of the multiple antenna elements 102 can vary between the first sub-set 120 and the second sub-set 122 of antenna elements 102 along the co-polarization direction 110 and not vary between the first sub-set 120 and the second sub-set 122 of antenna elements 102 along the cross-polarization direction 112. This creates an asymmetry within the polarized antenna array 100.

In FIG. 1, an orientation of the multiple antenna elements relative to the co-polarization direction and the cross-polarization direction varies between the first sub-set and the second sub-set of antenna elements. The first sub-set 120 of antenna elements 102 and the second sub-set 122 of antenna elements 102 use the same type of antenna element 102, however, the antenna elements 102 of the second sub-set 122 are physically rotated (within the plane of the array) relative to the antenna elements 102 of the first sub-set 120. In the example illustrated the rotation is 180°.

As illustrated in FIGS. 3A &3B and 4A & 4B, an E-field component in the co-polarization direction 110 of the multiple antenna elements 102 having an opposite sense (direction) for the first sub-set 120 of antenna elements 102 compared to the second sub-set 122 of antenna elements 102 and an E-field component in the cross-polarization direction 112 of the multiple antenna elements 102 (if any) having the same sense (direction) for the first sub-set 120 of antenna elements 102 compared to the second sub-set 122 of antenna elements 102.

The multiple antenna elements 102 are arranged in a symmetric pattern such that antenna elements 102 of the first sub-set 120 of antenna elements alternate with antenna elements 102 of the second sub-set 122 of antenna elements. They alternate in the co-polarization direction 110, not the cross-polarization direction 112.

The first sub-set 120 of polarized antenna elements 102 are arranged along first straight lines 130 and the second sub-set 122 of polarized antenna elements are arranged along second straight lines 132. The first straight lines 130 and the second straights lines 132 alternate. The lines 130, 132 extend parallel to the cross-polarization direction 112 and alternate in the co-polarization direction 110.

The first sub-set 120 of polarized antenna elements 102 are arranged with even spacing along the first straight lines 130. The first straight lines 130 are evenly spaced apart.

The second sub-set 122 of polarized antenna elements 102 are arranged with even spacing along the second straight lines 132. The second straight lines 132 are evenly spaced apart.

The same spacing separates the antenna elements 102 in first straight lines 130 and the antenna elements 102 in the second straight lines 132.

The same spacing separates the first straight lines 130 and the second straight lines 132.

In this example but not necessarily all examples, the multiple antenna elements 102 are arranged in a planar regular array in parallel rows and parallel columns. The rows are parallel to the cross-polarization direction 112, and the columns are parallel to the co-polarization direction 110. The first sub-set 120 of polarized antenna elements 102 and the second sub-set 122 of polarized antenna elements 102 are arranged in alternate rows of the planar array. In this example, the first sub-set 120 of polarized antenna elements 102 are arranged in the odd rows and the second sub-set 122 of polarized antenna elements 102 are arranged in the even rows. The regular array is rectangular with one pair of the opposing sides of the rectangle arranged parallel to the co-polarization direction 110 and with the other pair of opposing sides of the rectangle arranged parallel to the cross-polarization direction 112.

In this example, but not necessarily all examples, each of the antenna elements 102 has reflective symmetry in an axis parallel to the co-polarization direction 110 and does not have reflective symmetry in an axis parallel to cross-polarization direction 112.

In this example, but not necessarily all examples, each of the antenna elements 102 is configured to have a polarization vector parallel to the co-polarization direction 110. In this example, but not necessarily all examples, each of the antenna elements 102 in the first sub-set 120 is configured to have a polarization vector (E-field) that has an opposite sense to the polarization vectors the antenna elements 102 in the second sub-set 122 (see FIGS. 3A and 3B).

Each of the antenna elements 102 can be configured to operate at the same operational frequency band.

The polarized antenna array 100 can comprise a large number of antenna elements, for example, more than 32 or 64 or 128 antenna elements 102.

As illustrated in FIG. 2, the polarized antenna array 100 is part of an apparatus 200 that also comprises circuitry 210 configured to apply a phase difference e.g. $\Delta\Phi$ between the first sub-set 120 of antenna elements 102 and the second sub-set 122 of antenna elements. In some examples the circuitry 210 comprises reactive components 212 configured to apply the phase difference. The reactive components 212 can, for example comprise at least an inductive reactance or a capacitive reactance. The reactive components 212 can, for example comprise one or more lumped reactive components such as capacitors and inductors, and resistors may also be used.

The phase difference e.g. $\Delta\Phi$ is applied between antenna feeds of the first sub-set 120 of antenna elements 102 and antenna feeds of the second sub-set 122 of antenna elements 102.

The phase difference causes constructive combination of the first polarization vector P1 and second polarization vector P2 in the co-polarization direction 110 and destructive combination of the first polarization vector P1 and the second polarization vector P2 in the cross-polarization direction 112.

In this example, the apparatus 10 additionally comprises beam steering circuitry 220. The beam steering circuitry 220 is configured to steer a radio frequency beam formed by the polarized antenna array 100. The beam steering circuitry 220 is configured to apply different phase shifts to the antenna elements 102. For example, an antenna element that is uniquely referenced by indexes i, j (e.g. row i, column j in a rectangular array) gets a phase shift $\Phi(i,j)$.

The combination of circuitry 210 and the beam steering circuitry 220 causes the second sub-set 122 of polarized antenna elements 122 to get a phase of $\Phi(i,j)+\Delta\Phi$ and the first sub-set 120 of polarized antenna elements 102 120 gets a phase of $\Phi(i',j')$. The additional phase difference between the first and second sets of polarized antenna elements is $\Delta\Phi$.

In the example of FIG. 1, the boresight of the polarized antenna array 100 is orthogonal to the co-polarization direction 110 and the cross-polarization direction 112 and extends out from the page. The boresight defines a polar axis from which a polar angle is measured and from which an azimuthal angle is measured. The polar angle is an elevation off a plane of the page and the azimuthal angle is an orientation within the plane of the page. Beam steering can for example change the polar angle and/or the azimuthal angle.

Figure 4A:
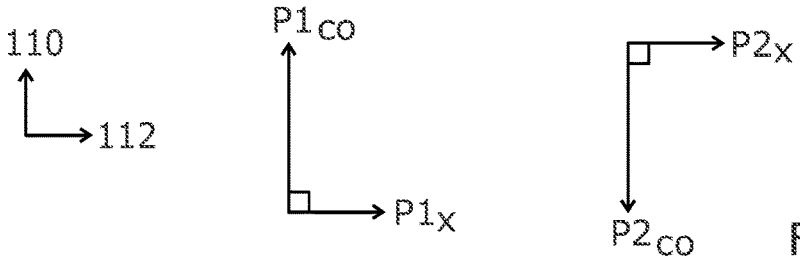
FIGS. 4A, 4B and 4C show another example embodiment of the subject matter described herein.
Figure 4B:
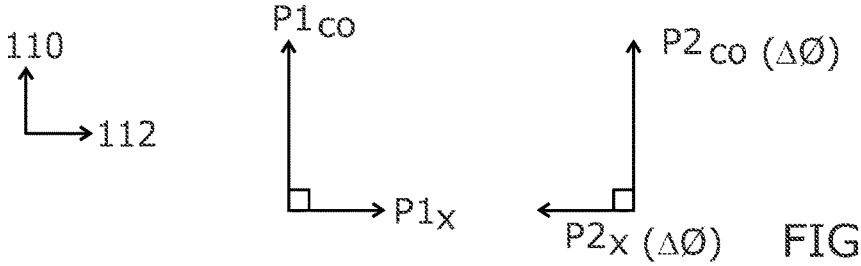
Figure 4C:
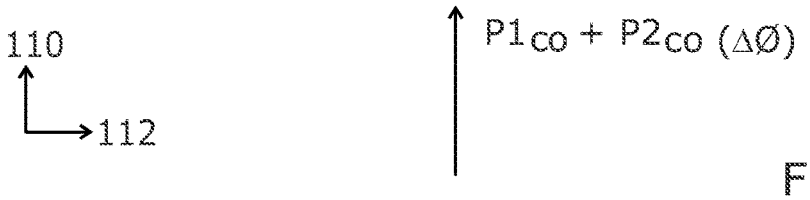

FIGS. 4A, 4B and 4C illustrate the effect of the phase difference applied by circuitry 210 at the polarized antenna array 100 when the azimuthal angle (steering angle) is changed away from being parallel to the co-polarization direction 110 towards being parallel to the cross-polarization direction 112.

The multiple polarized antenna elements 102 comprise a first sub-set 120 of polarized antenna elements 102 that collectively have a first polarization vector P1 and a second sub-set 122 of polarized antenna elements 102 that collectively have a second polarization vector P2.

FIG. 4A, illustrates polarization of the polarized antenna array 100 in absence of the applied phase difference. FIG. 4A illustrates a component $P1_{co}$ of the first polarization vector P1 in the co-polarization direction 110 and a component $P2_{co}$ of the second polarization vector P2 in the co-polarization direction 110. The component $P1_{co}$ of the first polarization vector P1 in the co-polarization direction 110 and the component $P2_{co}$ of the second polarization vector P2 in the co-polarization direction 110 are in opposite senses.

FIG. 4A illustrates a component $P1_x$ of the first polarization vector P1 in the cross-polarization direction 112 and a component $P2_x$ of the second polarization vector P2 in the cross-polarization direction 112. The component $P1_x$ of the first polarization vector P1 in the cross-polarization direction 112 and the component $P2_x$ of the second polarization vector P2 in the cross-polarization direction 112 are in the same sense.

The first polarization vector P1 and second polarization vector P2 have opposite-sense components in the co-polarization direction 110 and same-sense components in the cross-polarization direction 112.

FIG. 4B illustrates the effect of the phase difference applied by circuitry 210 at the polarized antenna array 100 is illustrated in FIG. 1.

The phase difference in this example is applied to the second sub-set 122 of antenna elements 102 and causes a phase change in the component $P2_{co}$ of the second polarization vector P2 in the co-polarization direction 110. In this example, a phase change of 180° is applied to the second sub-set 122 of antenna elements 102 (relative to the first sub-set 120 of antenna elements 102) by the circuitry 210. The component $P1_{co}$ of the first polarization vector P1 in the co-polarization direction 110 is unchanged. The sense of the component $P2_{co}$ of the second polarization vector P2 in the co-polarization direction 110 is reversed. The component $P1_{co}$ of the first polarization vector P1 in the co-polarization direction 110 and the component $P2_{co}$ of the second polarization vector P2 in the co-polarization direction 110 (after phase change) are in the same sense.

The phase difference also causes a phase change in the component $P2_x$ of the second polarization vector P2 in the cross-polarization direction 112. In this example, a phase change of 180° is applied. The component $P1_x$ of the first polarization vector P1 in the cross-polarization direction 112 is unchanged. The sense of the component $P2_x$ of the second polarization vector P2 in the cross-polarization direction 112 is reversed. The component $P1_x$ of the first polarization vector P1 in the cross-polarization direction 112 and the component $P2_x$ of the second polarization vector P2 in the cross-polarization direction 112 (after phase change) are in the opposite sense.

The first polarization vector P1 and adapted second polarization vector P2 (after phase change) have same-sense components in the co-polarization direction 110 and opposite-sense components in cross-polarization 112.

FIG. 4C illustrates the effect of the phase difference applied by circuitry 210 in the far-field of an antenna beam. In the far-field, the component $P1_{co}$ of the first polarization vector P1 in the co-polarization direction 110 and the component $P2_{co}$ of the second polarization vector P2 in the co-polarization direction 110 (after phase change) constructively combine because they have the same sense. In the far-field, the component $P1_x$ of the first polarization vector P1 in the cross-polarization direction 112 and the component $P2_x$ of the second polarization vector P2 in the cross-polarization direction 112 (after phase change) destructively combine because they have opposite sense.

The polarized antenna array 100 therefore has high (good) cross-polar discrimination.

Figure 5:
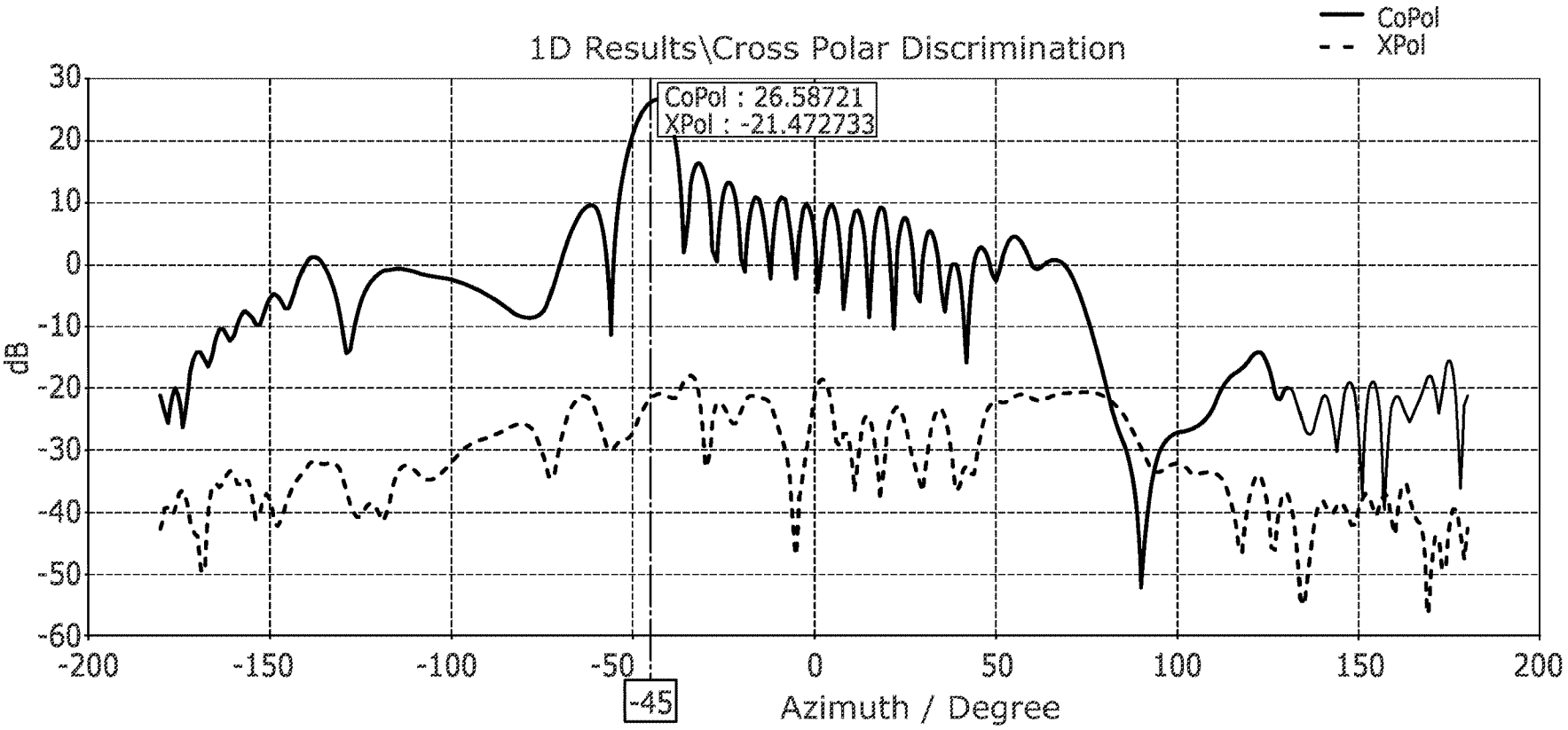
FIG. 5 shows an example embodiment of the subject matter described herein.

FIG. 5 illustrates experimental results demonstrating improved cross-polar discrimination across different azimuthal angles.

The polarized antenna array 100 illustrated in FIG. 1 comprises:

a first sub-set 120 of polarized antenna elements 102 that are arranged in first lines 130 that are separated in a first direction 110 and extend in a second direction 112 orthogonal to the first direction 110 wherein each of the polarized antenna elements 102 in the first sub-set 120 have an axis of reflection symmetry parallel to the first direction 110;

a second sub-set 122 of polarized antenna elements 102 that are arranged in second lines 132 that are separated in the first direction 110 and extend in the second direction 112 wherein each of the polarized antenna elements 102 in the second sub-set 122 have an axis of reflection symmetry parallel to the first direction 110;

wherein the first and second lines 130, 132 alternate and wherein the polarized antenna elements 102 in the first sub-set 120 are rotated 180°, within a plane occupied by the first and second lines 130, 132, relative to the polarized antenna elements 102 in the second sub-set 122.

Figure 6:
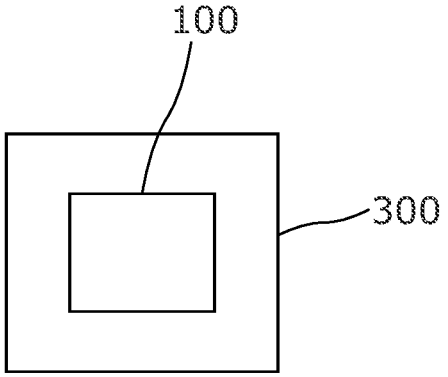
FIG. 6 shows another example embodiment of the subject matter described herein.

As illustrated in FIG. 6, in some but not necessarily all examples the antenna elements 102 are elements supported by a common printed circuit board 300.

The antenna elements 102 may be configured to operate the same operational resonant frequency band. For example, the operational frequency bands may include (but are not limited to) Long Term Evolution (LTE) (US) (734 to 746 MHz and 869 to 894 MHz), Long Term Evolution (LTE) (rest of the world) (791 to 821 MHz and 925 to 960 MHz), amplitude modulation (AM) radio (0.535-1.705 MHz); frequency modulation (FM) radio (76-108 MHz); Bluetooth (2400-2483.5 MHz); wireless local area network (WLAN) (2400-2483.5 MHz); hiper local area network (HiperLAN) (5150-5850 MHz); global positioning system (GPS) (1570.42-1580.42 MHz); US-Global system for mobile communications (US-GSM) 850 (824-894 MHz) and 1900 (1850-1990 MHz); European global system for mobile communications (EGSM) 900 (880-960 MHz) and 1800 (1710-1880 MHz); European wideband code division multiple access (EU-WCDMA) 900 (880-960 MHz); personal communications network (PCN/DCS) 1800 (1710-1880 MHz); US wideband code division multiple access (US-WCDMA) 1700 (transmit: 1710 to 1755 MHz, receive: 2110 to 2155 MHz) and 1900 (1850-1990 MHz); wideband code division multiple access (WCDMA) 2100 (transmit: 1920-1980 MHz, receive: 2110-2180 MHz); personal communications service (PCS) 1900 (1850-1990 MHz); time division synchronous code division multiple access (TD-SCDMA) (1900 MHz to 1920 MHz, 2010 MHz to 2025 MHz), ultra wideband (UWB) Lower (3100-4900 MHz); UWB Upper (6000-10600 MHz); digital video broadcasting-handheld (DVB-H) (470-702 MHz); DVB-H US (1670-1675 MHz); digital radio mondiale (DRM) (0.15-30 MHz); worldwide interoperability for microwave access (WiMax) (2300-2400 MHz, 2305-2360 MHz, 2496-2690 MHz, 3300-3400 MHz, 3400-3800 MHz, 5250-5875 MHz); digital audio broadcasting (DAB) (174.928-239.2 MHz, 1452.96-1490.62 MHz); radio frequency identification low frequency (RFID LF) (0.125-0.134 MHz); radio frequency identification high frequency (RFID HF) (13.56-13.56 MHz); radio frequency identification ultra high frequency (RFID UHF) (433 MHz, 865-956 MHz, 2450 MHz).

An operational frequency band is a frequency band over which an antenna can efficiently operate. It is a frequency range where the antenna's return loss is less than an operational threshold.

As used in this application, the term 'circuitry' may refer to one or more or all of the following:

(a) hardware-only circuitry implementations (such as implementations in only analog and/or digital circuitry) and (b) combinations of hardware circuits and software, such as (as applicable):

(i) a combination of analog and/or digital hardware circuit(s) with software/firmware and (ii) any portions of hardware processor(s) with software (including digital signal processor(s)), software, and memory(ies) that work together to cause an apparatus, such as a mobile phone or server, to perform various functions and (c) hardware circuit(y) and or processor(s), such as a microprocessor(s) or a portion of a microprocessor(s), that requires software (e.g. firmware) for operation, but the software may not be present when it is not needed for operation.

This definition of circuitry applies to all uses of this term in this application, including in any claims. As a further example, as used in this application, the term circuitry also covers an implementation of merely a hardware circuit or processor and its (or their) accompanying software and/or firmware. The term circuitry also covers, for example and if applicable to the particular claim element, a baseband integrated circuit for a mobile device or a similar integrated circuit in a server, a cellular network device, or other computing or network device.

Where a structural feature has been described, it may be replaced by means for performing one or more of the functions of the structural feature whether that function or those functions are explicitly or implicitly described.

The above described examples find application as enabling components of:

automotive systems; telecommunication systems; electronic systems including consumer electronic products; distributed computing systems; media systems for generating or rendering media content including audio, visual and audio visual content and mixed, mediated, virtual and/or augmented reality; personal systems including personal health systems or personal fitness systems; navigation systems; user interfaces also known as human machine interfaces; networks including cellular, non-cellular, and optical networks; ad-hoc networks; the internet; the internet of things; virtualized networks; artificial intelligence devices and systems; and related software and services.

The term 'comprise' is used in this document with an inclusive not an exclusive meaning. That is any reference to X comprising Y indicates that X may comprise only one Y or may comprise more than one Y. If it is intended to use 'comprise' with an exclusive meaning then it will be made clear in the context by referring to "comprising only one . . ." or by using "consisting".

In this description, reference has been made to various examples. The description of features or functions in relation to an example indicates that those features or functions are present in that example. The use of the term 'example' or 'for example' or 'can' or 'may' in the text denotes, whether explicitly stated or not, that such features or functions are present in at least the described example, whether described as an example or not, and that they can be, but are not necessarily, present in some of or all other examples. Thus 'example', 'for example', 'can' or 'may' refers to a particular instance in a class of examples. A property of the instance can be a property of only that instance or a property of the class or a property of a sub-class of the class that includes some but not all of the instances in the class. It is therefore implicitly disclosed that a feature described with reference to one example but not with reference to another example, can where possible be used in that other example as part of a working combination but does not necessarily have to be used in that other example.

Although embodiments have been described in the preceding paragraphs with reference to various examples, it should be appreciated that modifications to the examples given can be made without departing from the scope of the claims Features described in the preceding description may be used in combinations other than the combinations explicitly described above.

Although functions have been described with reference to certain features, those functions may be performable by other features whether described or not.

Although features have been described with reference to certain embodiments, those features may also be present in other embodiments whether described or not.

The term 'a' or 'the' is used in this document with an inclusive not an exclusive meaning. That is any reference to X comprising a/the Y indicates that X may comprise only one Y or may comprise more than one Y unless the context clearly indicates the contrary. If it is intended to use 'a' or 'the' with an exclusive meaning then it will be made clear in the context. In some circumstances the use of 'at least one' or 'one or more' may be used to emphasis an inclusive meaning but the absence of these terms should not be taken to infer and exclusive meaning.

The presence of a feature (or combination of features) in a claim is a reference to that feature or (combination of features) itself and also to features that achieve substantially the same technical effect (equivalent features). The equivalent features include, for example, features that are variants and achieve substantially the same result in substantially the same way. The equivalent features include, for example, features that perform substantially the same function, in substantially the same way to achieve substantially the same result.

In this description, reference has been made to various examples using adjectives or adjectival phrases to describe characteristics of the examples. Such a description of a characteristic in relation to an example indicates that the characteristic is present in some examples exactly as described and is present in other examples substantially as described.

Whilst endeavoring in the foregoing specification to draw attention to those features believed to be of importance it should be understood that the Applicant may seek protection via the claims in respect of any patentable feature or combination of features hereinbefore referred to and/or shown in the drawings whether or not emphasis has been placed thereon.

We claim:

1. A polarized antenna array comprising multiple polarized antenna elements, wherein the polarized antenna array has a polarization vector defining a co-polarization direction and a cross-polarization direction, wherein the multiple polarized antenna elements comprise a first sub-set of polarized antenna elements that collectively have a first polarization vector and a second sub-set of polarized antenna elements that collectively have a second polarization vector, wherein application of a controlled phase difference between the first sub-set of polarized antenna elements and the second sub-set of polarized antenna elements causes constructive combination of the first polarization vector and second polarization vector in the co-polarization direction and destructive combination of the first polarization vector and the second polarization vector in the cross-polarization direction.

2. A polarized antenna array as claimed in claim 1, wherein one or more characteristics of the multiple antenna elements vary between the first sub-set and the second sub-set of antenna elements along the co-polarization direction and do not vary between the first sub-set and the second sub-set of antenna elements along the cross-polarization direction.

3. A polarized antenna array as claimed in claim 1, wherein an E-field component in the co-polarization direction of the multiple antenna elements has opposite sense for the first sub-set of antenna elements compared to the second sub-set of antenna elements and an E-field component in the cross-polarization direction of the multiple antenna elements has same sense for the first sub-set of antenna elements compared to the second sub-set of antenna elements.

4. A polarized antenna array as claimed in claim 1, wherein an orientation of the multiple antenna elements relative to the co-polarization direction and the cross-polarization direction varies between the first sub-set and the second sub-set of antenna elements.

5. A polarized antenna array as claimed in claim 1, wherein multiple antenna elements are arranged in a symmetric pattern such that antenna elements of the first sub-set of antenna elements alternate with antenna elements of the second sub-set of antenna elements.

6. A polarized antenna array as claimed in claim 1, wherein the first sub-set of polarized antenna elements are arranged along first straight lines and the second sub-set of polarized antenna elements are arranged along second straight lines, wherein the first straight lines and the second straight lines alternate.

7. A polarized antenna array as claimed in claim 6, wherein the first sub-set of polarized antenna elements are arranged with even spacing along the first straight lines and the first straight lines are evenly spaced apart, and the second sub-set of polarized antenna elements are arranged with even spacing along the second straight lines and the second straight lines are evenly spaced apart.

8. A polarized antenna array as claimed in claim 6, wherein the first straight lines and the second straight lines extend parallel to the cross-polarization direction.

9. A polarized antenna array as claimed in claim 1, wherein the first sub-set of polarized antenna elements and the second sub-set of polarized antenna elements are arranged in alternate rows of the planar array.

10. A polarized antenna array as claimed in claim 1, wherein the antenna elements have reflective symmetry in an axis parallel to the co-polarization direction and do not have reflective symmetry in an axis parallel to cross-polarization direction.

11. A polarized antenna array as claimed in claim 1, wherein the antenna elements are configured to have polarization vectors parallel to the co-polarization direction.

12. An apparatus comprising:

a polarized antenna array comprising multiple polarized antenna elements, wherein the polarized antenna array has a polarization vector defining a co-polarization direction and a cross-polarization direction, wherein the multiple polarized antenna elements comprise a first sub-set of polarized antenna elements that collectively have a first polarization vector and a second sub-set of polarized antenna elements that collectively have a second polarization vector; and circuitry configured to apply a phase difference between the first sub-set and the second sub-set that causes constructive combination of the first polarization vector and second polarization vector in the co-polarization direction and destructive combination of the first polarization vector and the second polarization vector in the cross-polarization direction.

13. An apparatus as claimed in claim 12, wherein the circuitry comprises reactive components configured to apply a phase difference between feeds of the first sub-set of antenna elements and feeds of the second sub-set of antenna elements.

14. An apparatus as claimed in claim 12, further comprising beam steering circuitry configured to provide for beam steering using the polarized antenna array.

15. An apparatus as claimed in claim 12, wherein one or more characteristics of the multiple antenna elements vary between the first sub-set and the second sub-set of antenna elements along the co-polarization direction and do not vary between the first sub-set and the second sub-set of antenna elements along the cross-polarization direction.

16. An apparatus as claimed in claim 12, wherein an E-field component in the co-polarization direction of the multiple antenna elements has opposite sense for the first sub-set of antenna elements compared to the second sub-set of antenna elements and an E-field component in the cross-polarization direction of the multiple antenna elements has same sense for the first sub-set of antenna elements compared to the second sub-set of antenna elements.

17. An apparatus as claimed in claim 12, wherein an orientation of the multiple antenna elements relative to the co-polarization direction and the cross-polarization direction varies between the first sub-set and the second sub-set of antenna elements.

18. An apparatus as claimed in claim 12, wherein multiple antenna elements are arranged in a symmetric pattern such that antenna elements of the first sub-set of antenna elements alternate with antenna elements of the second sub-set of antenna elements.

19. A polarized antenna array comprising:

a first sub-set of polarized antenna elements that are arranged in first lines that are separated in a first direction and extend in a second direction orthogonal to the first direction, wherein each of the polarized antenna elements in the first sub-set have an axis of reflection symmetry parallel to the first direction; and a second sub-set of polarized antenna elements that are arranged in second lines that are separated in the first direction and extend in the second direction, wherein each of the polarized antenna elements in the second sub-set have an axis of reflection symmetry parallel to the first direction;

wherein the first and second lines alternate and wherein the polarized antenna elements in the first sub-set are physically rotated 180°, within a plane occupied by the first and second lines, relative to the polarized antenna elements in the second sub-set.

20. A polarized antenna array as claimed in claim 19, wherein the first sub-set of polarized antenna elements are arranged with even spacing along the first straight lines and the first straight lines are evenly spaced apart, and the second sub-set of polarized antenna elements are arranged with even spacing along the second straight lines and the second straight lines are evenly spaced apart.

* * * * *